US007971288B2

(12) United States Patent
Hackett

(10) Patent No.: US 7,971,288 B2
(45) Date of Patent: Jul. 5, 2011

(54) WASTE FITTING

(75) Inventor: Donald Hackett, Ballygawley (GB)

(73) Assignee: Classic Marble (Showers) Ltd., Garvaghey (GB)

( * ) Notice: Subject to any disclaimer, the term of this patent is extended or adjusted under 35 U.S.C. 154(b) by 832 days.

(21) Appl. No.: 10/595,380

(22) PCT Filed: Oct. 13, 2004

(86) PCT No.: PCT/EP2004/011612

§ 371 (c)(1),
(2), (4) Date: Jan. 25, 2008

(87) PCT Pub. No.: WO2005/040511

PCT Pub. Date: May 6, 2005

(65) Prior Publication Data

US 2009/0007329 A1 Jan. 8, 2009

(30) Foreign Application Priority Data

Oct. 13, 2003 (GB) ..... 0323945.6

(51) Int. Cl.
*E03C 1/12* (2006.01)

(52) U.S. Cl. ..... 4/679

(58) Field of Classification Search ..... 4/679, 680, 4/682, 694, 286, 287, 293, 295
See application file for complete search history.

(56) References Cited

U.S. PATENT DOCUMENTS 797,829 A * 8/1905 Weaver ..... 4/584
1,901,118 A * 3/1933 Pope ..... 4/683
2,705,809 A * 4/1955 McNamara ..... 4/255.02

* cited by examiner

*Primary Examiner* — Huyen Le
(74) *Attorney, Agent, or Firm* — Porter, Wright, Morris & Arthur, LLP

(57) ABSTRACT

A waste fitting for a basin, or similar item, comprising a first open end, a second open end and an inlet between the first and second ends. The waste fitting comprises a first seat for a plug, the inlet being located between the first seat and the second end, and a second seat for a plug, the second seat being located between the inlet and the second end. The inlet is connected in use to the overflow of the basin or similar item. With the plug in the second seat, the portion of the waste fitting above the plug, and the overflow system, may be filled with and may retain a cleaning or disinfecting product.

13 Claims, 3 Drawing Sheets

WASTE FITTING

FIELD OF THE INVENTION

The present invention relates to waste fittings, in particular waste fittings for wash basins, baths, sinks or similar fixtures.

BACKGROUND TO THE INVENTION

Conventional waste fittings provide a connection between a water outlet of a fixture such as a wash basin, sink or a bath, and a trap or waste pipe leading to a drain or the like. Such waste fittings generally comprise a short tubular sleeve having an external screw-thread for connecting the waste fitting to the waste pipe. A grille is often seated within the waste fitting to prevent waste material above a certain size from passing through. The grille may be removable to enable the tubular sleeve to be cleaned.

It is also known for wash basins and baths to be provided with an overflow system including an overflow drainage hole provided in a wall of the wash basin or bath, usually just below the taps, and a conduit leading from the overflow drain hole. The overflow system may be integrally formed with the wash basin or bath, in which case the overflow conduit leads to, and joins, the waste pipe. Although such overflow systems are useful in preventing the wash basin or bath from overflowing and flooding, they tend to pick up dirt, grime and waste material over time. It is particularly difficult to clean the overflow conduit due to its relatively inaccessible location.

Typically, cleaning/disinfecting liquids that are poured down the waste fitting or the overflow conduit flow down through the sleeve or conduit and out through the waste pipe. The cleaning/disinfecting liquids therefore have minimal contact with the sleeve or conduit, rendering this an ineffective method for cleaning and/or disinfecting the waste fitting and the overflow conduit.

It is an object of the present invention to mitigate some or all of the disadvantages of the prior art.

SUMMARY OF THE INVENTION

A first aspect of the invention provides a waste fitting comprising a first open end, a second open end in liquid communication with the first open end, and an inlet between the first and second ends, the waste fitting further comprising means for retaining a plug in a first position, the inlet being located between the first position and the second end, and means for retaining a plug in a second position, the second position being located between the inlet and the second end.

One or both of said retaining means may comprise a respective seat for a plug.

In a preferred embodiment, a seat for a grille is provided at or adjacent said first end, the grille, when seated in the waste fitting, providing said means for retaining a plug in said first position. The grille preferably includes a collar portion, the collar portion providing said means for retaining a plug in said first position. The collar portion is preferably located within said first end generally at said first position.

In a preferred embodiment, the waste fitting comprises a sleeve-like body which provides said first and second open ends and in which said inlet is formed. The sleeve may be tapered at said first plug position such that the width of the sleeve narrows in a direction generally towards said second end. The sleeve may be tapered at said second plug position such that the width of the sleeve narrows in a direction generally towards said second end.

Typically, the sleeve is generally narrower at Said second position than at said first position. More typically, the sleeve is generally narrower at said second position than between said first position and said second position.

A preferred waste fitting comprises a first open end, a second open end and an inlet between the first and second ends. The preferred waste fitting further comprises a first seat for a plug, the inlet being located between the first seat and the second end, and a second seat for a plug, the second seat being located between the inlet and the second end. The inlet is connected in use to the overflow of the basin or similar item. With the plug in the second seat, the portion of the waste fitting above the plug, and the overflow system, may be filled with and may retain a cleaning or disinfecting product.

A second aspect of the invention provides a sanitary ware fixture, such as a sink, basin or a bath, comprising a waste fitting of the first aspect of the invention.

In use of a preferred embodiment, the sleeve is connected to an overflow system via a conduit, the inlet being arranged to receive said conduit, the plug and said sleeve being cooperable to enable said plug to move to a point along the length of the sleeve between the inlet and a second end of the sleeve. The removable grille sits in the first end of said sleeve and the plug sits into said grille. Preferably, the sleeve is shaped and dimensioned to enable the plug to have substantially sealing engagement with the sleeve at a point along its length. In this way, when the plug is located between the inlet and the second end of the sleeve, material located between the plug and the first end is prevented from passing the plug. Preferably, the sleeve and grille are cooperable to retain the plug at a point along its length between the first end and the inlet. Optionally, the grille is arranged to be reversibly seated within the sleeve.

Typically, in use the first end provides a water outlet provided at a lowermost part of a wash basin or a bath or other sanitary ware item.

Further advantageous aspects of the invention will become apparent to those ordinarily skilled in the art upon review of the following description of a specific embodiment and with reference to the accompanying drawings.

BRIEF DESCRIPTION OF THE DRAWINGS

An embodiment of the present invention is now described by way of example and with reference to the accompanying drawings, in which.

DETAILED DESCRIPTION OF THE DRAWINGS

Figure 1:
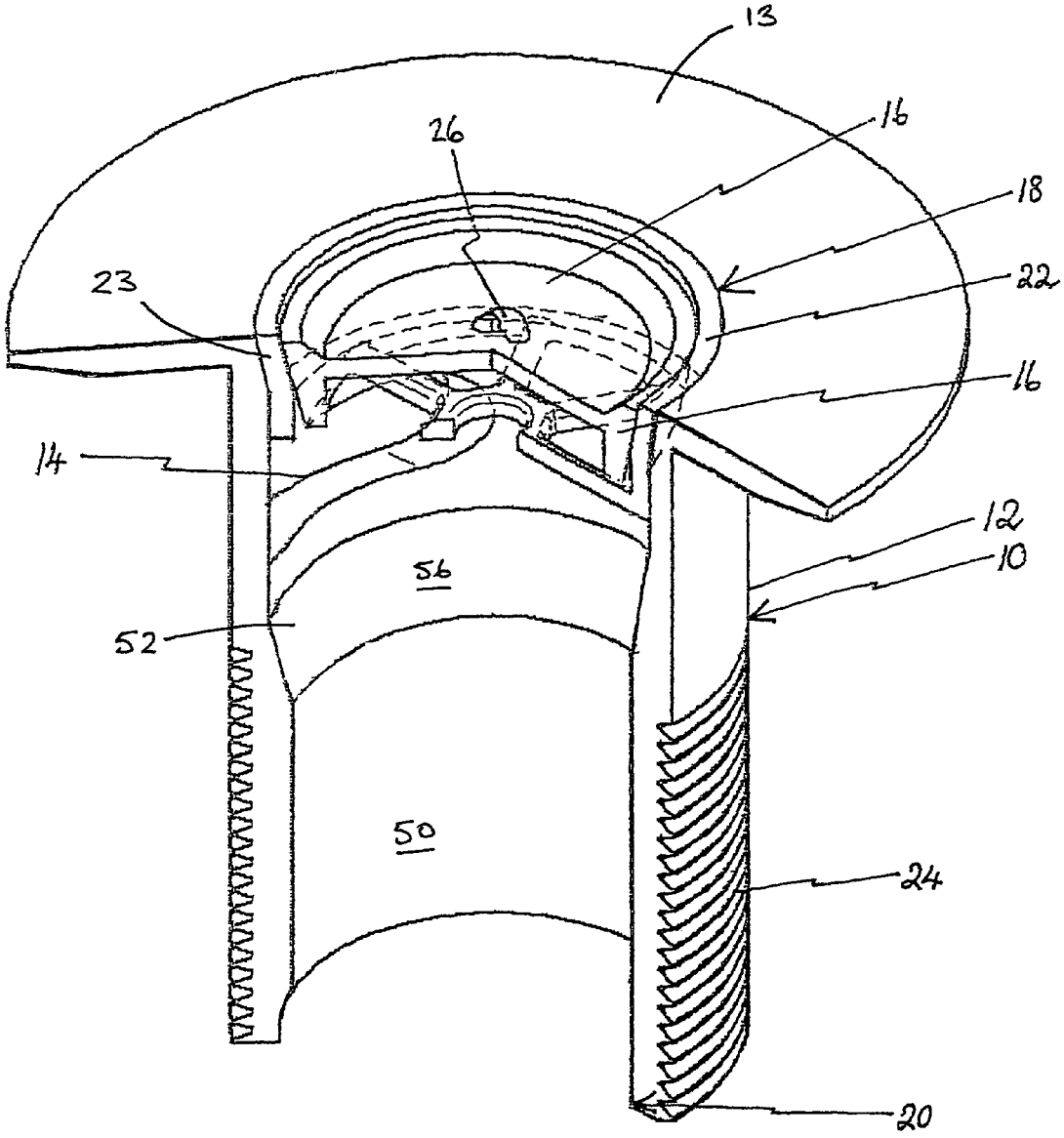
FIG. 1 is a partially cut-away perspective view of a waste fitting embodying the present invention, showing a plug in a first position of use.
Figure 2:
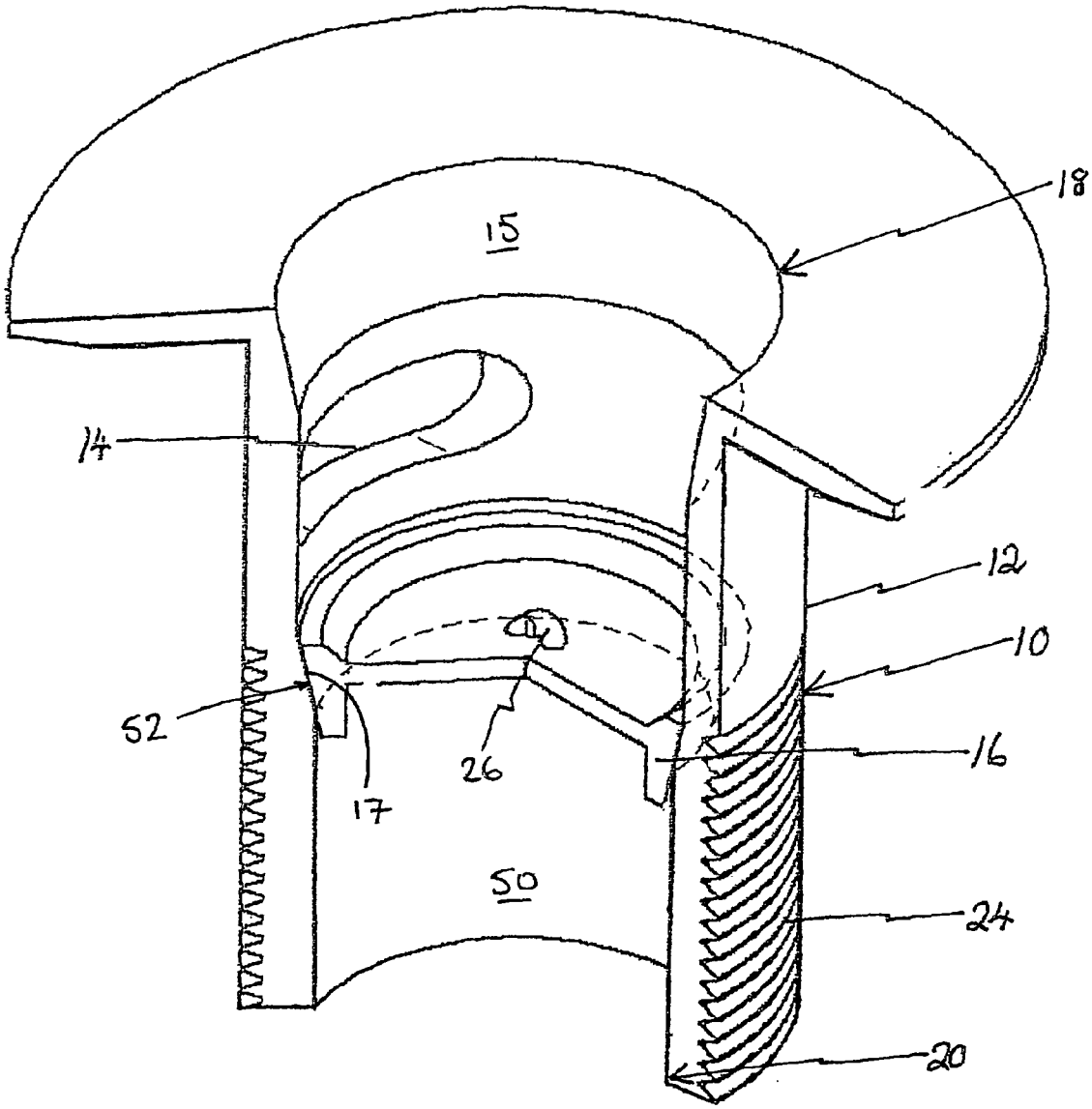
FIG. 2 is a partially cut-away perspective view of the waste fitting of FIG. 1, showing the plug in a second position of use.

Referring now to the accompanying drawings, there is shown an example of a waste fitting 10, or plug hole fitting, embodying the invention. The waste fitting 10 typically comprises a body in the form of a pipe or sleeve 12 having an inlet 14 located between first and second open ends 18, 20 of the sleeve 12. A flange 13 is typically provided around the open end 18. The waste fitting 10 is shaped and dimensioned to receive a plug 16 which, when fitted, prevents liquid from passing through the sleeve 12. In a first state, or position, of use, the plug 16 is seated in or adjacent the first end 18 of the sleeve 12 (as shown in FIG. 1) whereupon it substantially seals the first end 18 to the passage of liquid. The plug 16 and/or the sleeve 12 are also adapted, as is described in more detail hereinafter, to enable the plug 16, in a second state, or position, of use (as shown in FIG. 2), to be seated in sealing engagement with the sleeve 12 in a position between the inlet 14 and the second end 20 of the sleeve 12, thereby substantially sealing the sleeve 12 between the inlet 14 and the second end 20. The sleeve 12 is typically, but not necessarily, generally cylindrical or tubular in shape.

In the preferred embodiment, the sleeve 12 is connectable to an overflow system (not shown), or is integrally formed with an overflow system, such that a conduit (not shown) directs waste liquid, during use, into the sleeve 12 via inlet 14.

Figure 3:
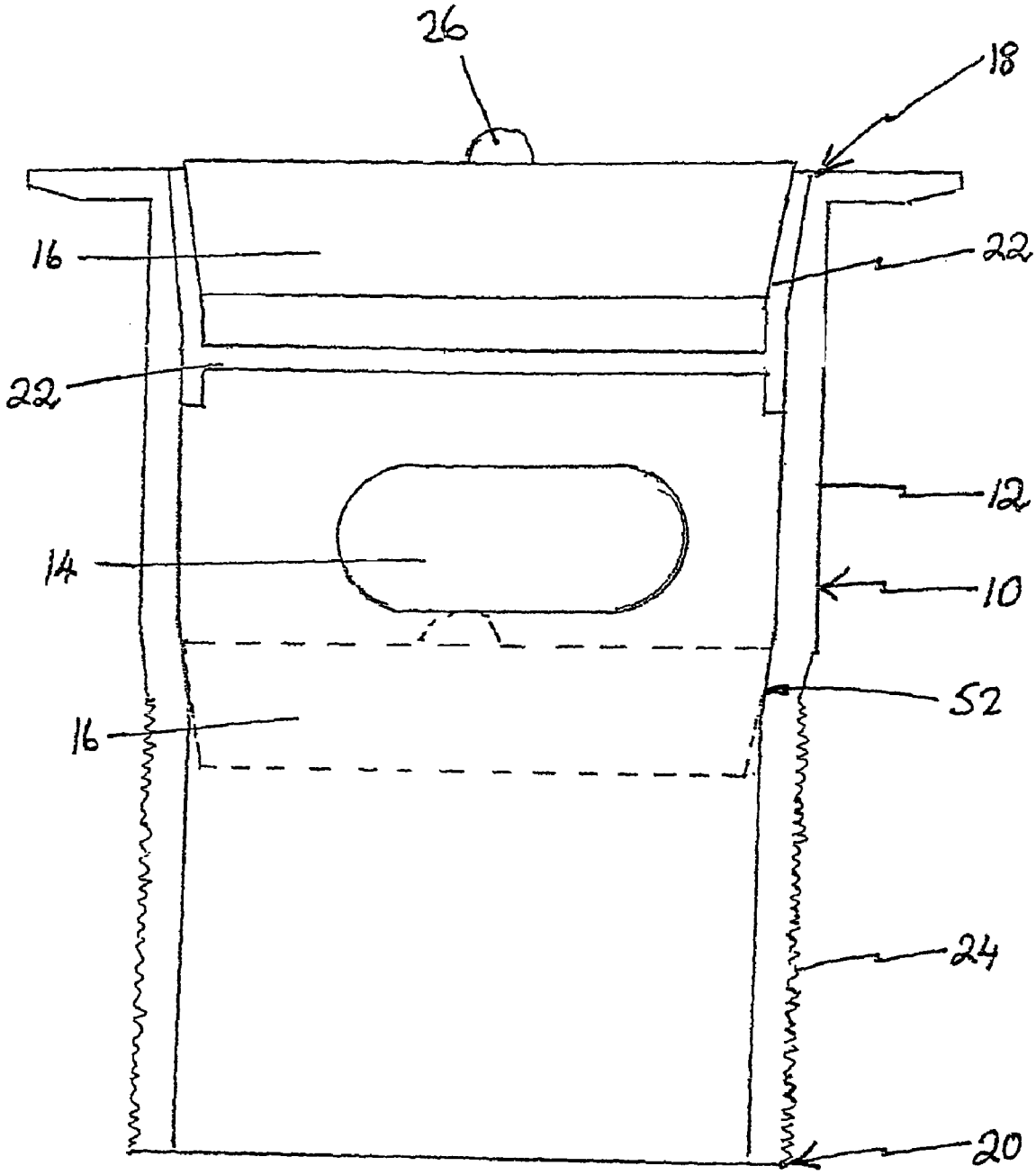
FIG. 3 is a cross-sectional view of the waste fitting of FIGS. 1 and 2.

The waste fitting 10 may include a removable grille 22 shaped and dimensioned to be seated in, at or adjacent the first end 18 of the sleeve 12. The preferred arrangement is such that the grille 22, when seated in the end 18, forms a seal between its outer periphery and the first end 18. The grille 22 preferably includes a collar portion 23 that, when the grille is fitted, extends around the internal periphery of the first end 18 to form said seal. The collar portion 23 provides a seat for the plug 16. The plug 16 may therefore be shaped and dimensioned to be seated in the grille 22, and more particularly within the collar portion 23, in its first state of use, as shown in FIG. 1. In a preferred embodiment, the sleeve 12 is tapered (so that the width of the sleeve narrows in a direction from the first end 18 to the second end) at the end 18 to provide a seat 15 for the grille 22. The outer periphery of the grille 22, and in particular of the collar 23, may be tapered to generally match the taper of the end 18. Optionally, the grille 22 may include a flange (not illustrated) provided around the mouth of the grille 22 (which in the drawings is defined by the in use upper edge of the collar 23) and extending generally perpendicular to the longitudinal axis of the grille 22 (and of the sleeve 12 when fitted). In a preferred embodiment, the flange of the grille 22 may replace the flange 13 shown in FIGS. 1 to 3.

In preferred embodiments, the interior wall 50 of the sleeve 12 is shaped to define retaining means in the form of a shoulder portion 52. The shoulder portion 52, which is located between the inlet 14 and the second end 20, provides a seat for the plug 16 in its second state of use. The shoulder portion 52 preferably extends around the entire wall 50. Preferably, the shoulder portion 52 provides a seat surface 56 that is inclined with respect to the longitudinal axis of the sleeve 12 such that the internal width of the sleeve 12 narrows in a direction away from the first end 18 of the sleeve 12. Hence, the interior wall 50 tapers or narrows in a direction away from the first end 18. The plug 16 advantageously has a tapered outer rim 17 that substantially matches the angle of inclination of the surface 56. As a result, the plug 16 forms an effective seal when seated on the shoulder portion 52.

Alternatively, the sleeve 12 may be provided with other retaining means, such as one or more lips or flanges (not shown), that extend wholly or partially around the interior wall 50 between the inlet 14 and the second end 20 of the sleeve.

During use, the waste fitting 10 is fitted to a fixture such as a wash basin or bath (not shown). In situ, the waste fitting 10 typically provides a connection between a water outlet (not shown) of the fixture and a waste trap (not shown) or pipe (not shown), typically leading to a drain (not shown). In such cases the first end 18 defines a water outlet, e.g. a plug hole, in the fixture. The waste fitting 10 may be provided with a screw thread 24 on its external surface, typically adjacent the second end 20. The screw thread 24 may be used to secure the fitting 10 to the fixture and to the waste pipe or trap. In some cases, the waste fitting 10 may be integrally formed with the waste pipe or trap, in which case the second end 20 (which is nonetheless open) is not a free end as depicted in the drawings.

In the first state of use, both the grille 22 (when present) and the plug 16 are seated in the first end 18 of the sleeve 12, as shown in FIG. 1. Both the grille 22 and the plug 16 are typically substantially circular such that the grille 22 and the plug 16 are located substantially co-axially within the first end 18 of the sleeve 12. The plug 16 has a width, or diameter, which is less than the first end 18 (by an amount substantially equal to the thickness of the collar portion 23). The plug 16 can be removed from the grille 22 as and when is desired, to enable waste material, in particular liquid waste such as water, to drain from the fixture and through the waste fitting 10.

When a user (not shown) wishes to clean the waste fitting 10 and/or the conduit (not shown) of the overflow system, the plug 16 may be moved into its second use position, below the inlet 14, in order to allow the overflow conduit (not shown) and the upper portion of the sleeve 12 to be filled with a disinfectant liquid or other disinfecting/cleaning agent. In the preferred embodiment, in order to move the plug 16 to this position, the grille 22 is removed from the sleeve 12. The plug 16 is then pushed into the sleeve 12 towards the second end 20; using any suitable means (not shown), until the plug 16 is located between the inlet 14 and the second end 20. This is shown in FIG. 2 in which the plug 16 is seated on the seat 56 provided by the shoulder portion 52. The plug 16, which in the preferred embodiment has a width smaller than that of the upper portion (i.e. the region between the first end 18 and the shoulder 52) of the sleeve 12, is readily moved beneath the inlet 14 into the second use position. As previously described, beneath the inlet 14, the internal diameter of the sleeve 12 decreases. The decreased internal diameter may, for example, be a result of the thickness of the wall of the sleeve 12 being increased in this region (as illustrated in the drawings), although the invention is not limited in this way. Upon reaching the, in use, lower portion of the sleeve 12, the plug 16 may then be seated in sealing engagement with the sleeve 12, as illustrated in FIG. 2. The periphery or circumference of the plug 16 is preferably tapered, inwardly from the top to the bottom (as viewed in the drawings), so that the width of the plug 16 decreases from its in use top to its in use bottom. In the preferred embodiment, the taper of the plug 16 generally matches that of the shoulder portion 52 so that, when the plug 16 is seated on the shoulder portion 52, it forms a relatively effective seal with the sleeve 12.

In the position shown in FIG. 2, the plug 16 is releasably fitted within the sleeve 12 in sealing engagement therewith. Consequently, material located between the plug 16 and the first end 18 is prevented from passing the plug 16. By placing the plug 16 in this position, the user can fill either or both of the sleeve 12 and the overflow conduit (not shown) with a disinfectant or cleaning liquid or other substance. Since the liquid (or other substance) is prevented from passing the plug 16, it may be maintained in prolonged contact with the sleeve 12 and/or overflow conduit, making this an effective method for cleaning and/or disinfecting the sleeve 12 and/or overflow conduit. Once the sleeve 12 and/or the overflow conduit have been cleaned, the plug 16 can be removed from the sleeve 12 using any suitable means, thereby allowing the disinfecting/cleaning substance to drain from the waste fitting 10. For example, an elongate hook (not shown) may be used to engage a tab 26 provided on the plug 16, thus enabling the plug 16 to be drawn out of the sleeve 12.

As previously described, the sleeve 12 may be tapered between its first and second ends 18, 20, so as to provide a seat for the plug 16. It is noted that the grille 22 is not necessarily an essential component of the waste fitting 10. If the grille 22 is not part of the waste fitting, the plug 16 may be adapted, in any suitable way, to be movable between its first working position, i.e. at or adjacent the first end 18, and its second the position, i.e. between the inlet 14 and the second end 20. For example, the plug may comprise an expandable plug and may be at least partially formed from resiliently deformable material such that by placing pressure on, or compressing, certain parts of the plug 16, the width of the plug 16 may be changed. U.S. Pat. No. 6,419,104 discloses examples of expandable plugs. It is noted that, when expandable plugs are used, it is not essential to provide a shoulder portion between the inlet 14 and the second end 20 of the sleeve 12.

Optionally, the grille 22, if present, may be arranged to be reversibly seatable within the sleeve 12, by adapting the grille 22 and/or the sleeve 12 in any suitable way.

Alternatively, the waste fitting 10 may be used with two plugs (not shown), one being shaped and dimensioned to be seated in sealing engagement with the first end 18, and the other being shaped and dimensioned to be seated in sealing engagement, with the sleeve 12 below the inlet 14 as hereinbefore described.

Further, the waste fitting 10 may be used with any removable pop-up plug system (not shown), or any other lever operated plug system (not shown). In such cases, the pop-up system is typically present at the first end 18 of the sleeve 12 in place of the grille 22 and the plug 16. In order to clean the sleeve 12 and/or the conduit of the overflow system, the pop-up system is removed from the sleeve. A standard plug (not shown) may then be moved into the position below the inlet 14, as hereinbefore described. The waste fitting 10 may therefore be conveniently constructed (for example concerning the positioning of the inlet 14 along the length of the sleeve 12), so as to be compatible with any suitable pop-up system (not shown).

Although the present invention has been described as particularly suitable for use with a wash basin, a bath or the like, it will be appreciated that the waste fitting 10 is not limited to being used with such fixtures. The waste fitting 10 may alternatively be used with a shower (not shown) or a sink (not shown), or any other fixture.

The present invention is not limited to the embodiments described herein, which may be adapted or modified without departing from the scope of the invention.

The invention claimed is:

1. A sanitary ware fixture comprising a plug hole, an overflow system and a waste fitting, the waste fitting comprising a first open end defining said plug hole, a second open end in liquid communication with the first open end, and an inlet between the first and second ends, the waste fitting further comprising means for retaining a plug in said plug hole, the inlet being located between the plug hole and the second end, and means for retaining a plug in a second position, the second position being located between the inlet and the second end, wherein said overflow system comprises an overflow outlet in liquid communication with said inlet via an overflow conduit, and wherein, when said plug is in said second position, said plug prevents liquid from draining from said sanitary ware fixture via said overflow system or via said waste fitting.

2. A sanitary ware fixture as claimed in claim 1, wherein one or both of said retaining means comprises a respective seat for a plug.

3. A sanitary ware fixture as claimed in claim 1, further comprising a removable grille and a seat for said grille provided at or adjacent said first end, the grille, when seated in the waste fitting, providing said means for retaining a plug in said plug hole.

4. A sanitary ware fixture as claimed in claim 3, wherein the grille includes a collar portion, the collar portion providing said means for retaining a plug in said plug hole.

5. A sanitary ware fixture as claimed in claim 4, wherein said collar portion is locatable within said first end generally at said plug hole.

6. A sanitary ware fixture as claimed in claim 5, wherein the sleeve is tapered at said second plug position such that the width of the sleeve narrows in a direction generally towards said second end.

7. A sanitary ware fixture as claimed in claim 3, wherein said waste fitting has a first width at said first end and a second width at said second position, said second width being narrower than said first width, wherein said plug has a width that is substantially equal to said second width such that said plug may be retained at said second position.

8. A sanitary ware fixture as claimed in claim 7, wherein said grille includes a collar portion, the collar portion being locatable within said firs tend generally at said plug hole and providing said means for retaining a plug in said plug hole, wherein the collar has a width, the combined widths of the collar and said plug being substantially equal to said first width.

9. A sanitary ware fixture as claimed in claim 1, wherein the waste fitting comprises a sleeve-like body which provides said first and second open ends and in which said inlet is formed.

10. A sanitary ware fixture as claimed in claim 9, wherein the sleeve is tapered at said plug hole such that the width of the sleeve narrows in a direction generally towards said second end.

11. A sanitary ware fixture as claimed in claim 9, wherein the sleeve is generally narrower at said second position than at said plug hole.

12. A sanitary ware fixture as claimed in claim 11, wherein said sleeve is generally narrower at said second position than between said plug hole and said second position.

13. A sanitary ware fixture as claimed in claim 1, wherein said plug is reversably expandable in width.

* * * * *